United States Patent [19]

Parmet

[11] Patent Number: 4,566,292

[45] Date of Patent: Jan. 28, 1986

[54] HELMET COOLER

[76] Inventor: Lawrence S. Parmet, 4358 Inveraray Walk, Roswell, Ga. 30075

[21] Appl. No.: 668,569

[22] Filed: Nov. 5, 1984

[51] Int. Cl.[4] ..... F25D 3/08

[52] U.S. Cl. ..... 62/457; 62/530; D7/5; D7/78; 215/286

[58] Field of Search ..... 62/457, 530, 531; 215/286; D7/5, 78

[56] References Cited

U.S. PATENT DOCUMENTS

| | | | |
|---|---|---|---|
| D. 218,349 | 8/1970 | Feeney | D7/78 |
| D. 232,011 | 7/1974 | Denton | D7/5 |
| 328,115 | 10/1885 | Gilberds | 215/286 X |
| 782,806 | 2/1905 | Crawford et al. | 215/286 |
| 1,941,337 | 12/1933 | Cato et al. | 215/286 |
| 2,570,300 | 10/1951 | Acton | 62/457 |

*Primary Examiner*—Lloyd L. King

*Attorney, Agent, or Firm*—Patrick F. Henry

[57] ABSTRACT

An insulated container looks like a football helmet and has a pivoted face guard which serves as a handle to hold the removable top of the container in place, for example during transit, but which pivots to a frontal position like a face guard. The handle has opposed projecting members thereon slidably engaging notches formed in projections on a removable top of the container and also respective side cushion pads which are seated into cavities on each side all for the purpose of holding the handle and top in place.

10 Claims, 10 Drawing Figures

HELMET COOLER

The field of invention is portable, insulated coolers of the sort used to transport cans of soft drinks and the like with ice inside to keep the drinks cool. The cooler has a removable top and a handle and the appearance of the cooler is that of a football or other helmet (e.g. motorcycle) with a face guard which serves as the handle and as a means of holding the removable top in place.

Portable insulated coolers are well known in the art. There are a number of small coolers on the market which comprise containers with handle and some sort of closure. There are also portable coolers which resemble football or other similar helmets as shown in U.S. Pat. Nos. Des. 218,349 and 232,011. However, the present arrangement in an insulated portable cooler of a removable top of the simulated container corresponding to the top of a football helmet by means of a pivotal handle which serves in one position as the face mask for the helmet and in another carrying position as both the handle and the means for holding the removable top in place is new and is not shown in the above-noted patents.

An object of this invention is to provide a portable container which is molded to look like a football helmet and has a handle which serves as a face mask and a latching means for a removable top closure that corresponds to the helmet top.

Another object of this invention is to provide a portable cooler which looks like a football helmet complete with a face guard that serves as a closure latching handle and which is capable of holding twelve cans of soft drink.

An additional object resides in the construction wherein the inside is a container insulated by foam and the like.

Accordingly, the present invention is a football or other helmet insulated cooler which has an insulated compartment space therein capable of holding a number of cans of soft drink and a removable top closure member which is the major part of the top of the helmet held in place by means of a pivotal handle which serves as the face mask for the helmet in one position extending forwardly and in the top position serving as the means for holding the top in place. The handle is pivotally attached on opposite sides of the container adjacent the ear flap portions and includes a pair of spaced tapered projecting members on the inside of the top which engage projecting notches on the removable top for holding same in place but for detachment therefrom. Pressure pads are located on opposite sides of the container adjacent each of the respective ear flaps indicated thereon for pressure seating in cavities formed in the container to hold the handle firmly in place.

Other and further objects and advantages of this invention will become apparent upon reading the following description of a preferred embodiment taken in conjunction with the accompanying drawings in which.

DESCRIPTION OF A PREFERRED EMBODIMENT

Figure 7:
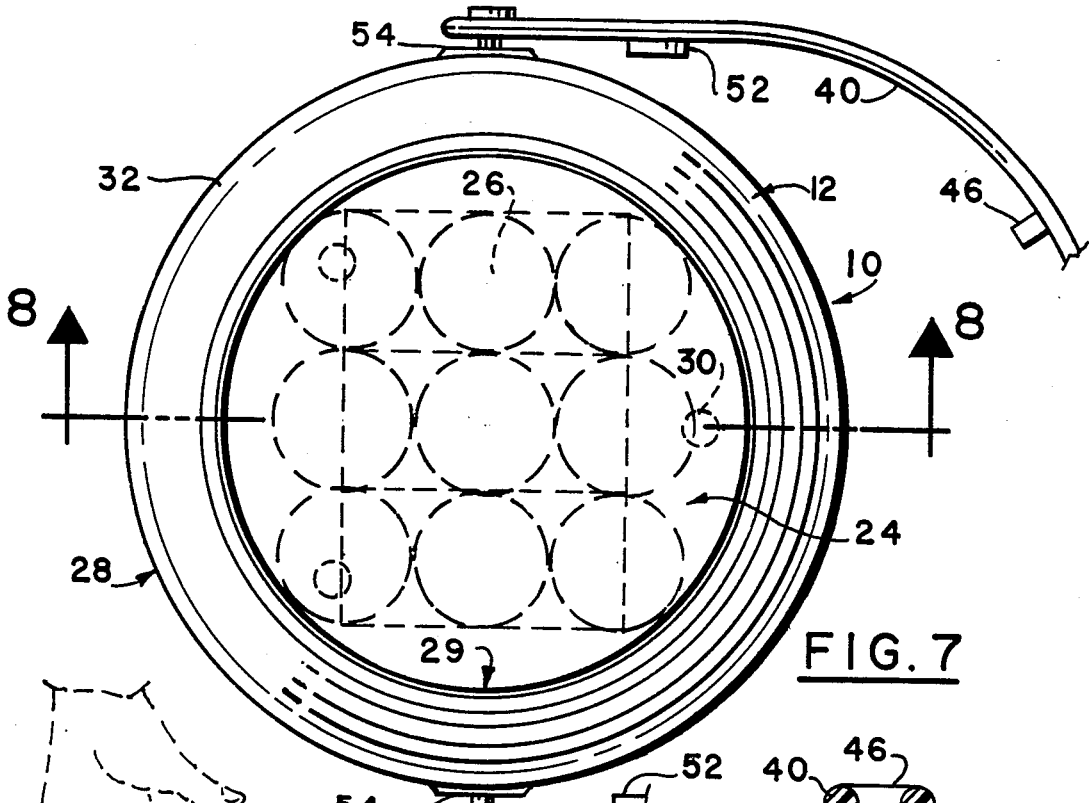
FIG. 7 is a plan view with top removed and handle broken away showing the cans inside.
Figure 9:
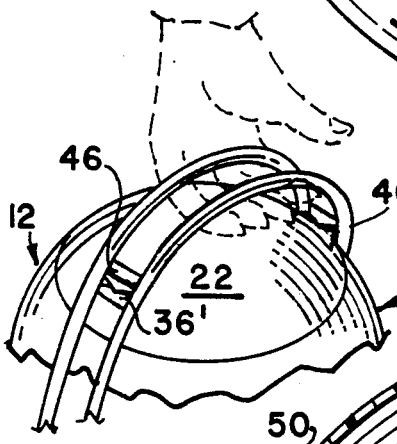
FIG. 9 is a partial perspective view showing the handle in carrying position.
Figure 10:
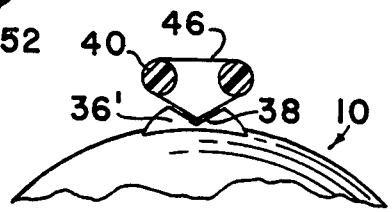
FIG. 10 is a detailed view taken substantially along lines 10—10 in FIG. 4.

The cooler 10 looks like a football or other similar helmet 12 which appears as the major portion of the apparent outside body of the cooler 10 that has a non-helmet portion 14 occupying the space which would normally be the exposed face portion of the wearer corresponding to the face portion 16 and the neck portion 18. Helmet 12 comprises the usual ear flap 20 on opposite sides with the top of the helmet 12, unlike a conventional football helmet, comprising a detachable closure 22 which is removable to expose the open interior 24 which as seen in the drawings (e.g. FIGS. 7 and 8) is capable of holding 12 cans 26 of soft drink. Closure 22 has an outer wall 27 and an inner wall 27' which define an air space therebetween.

Figure 8:
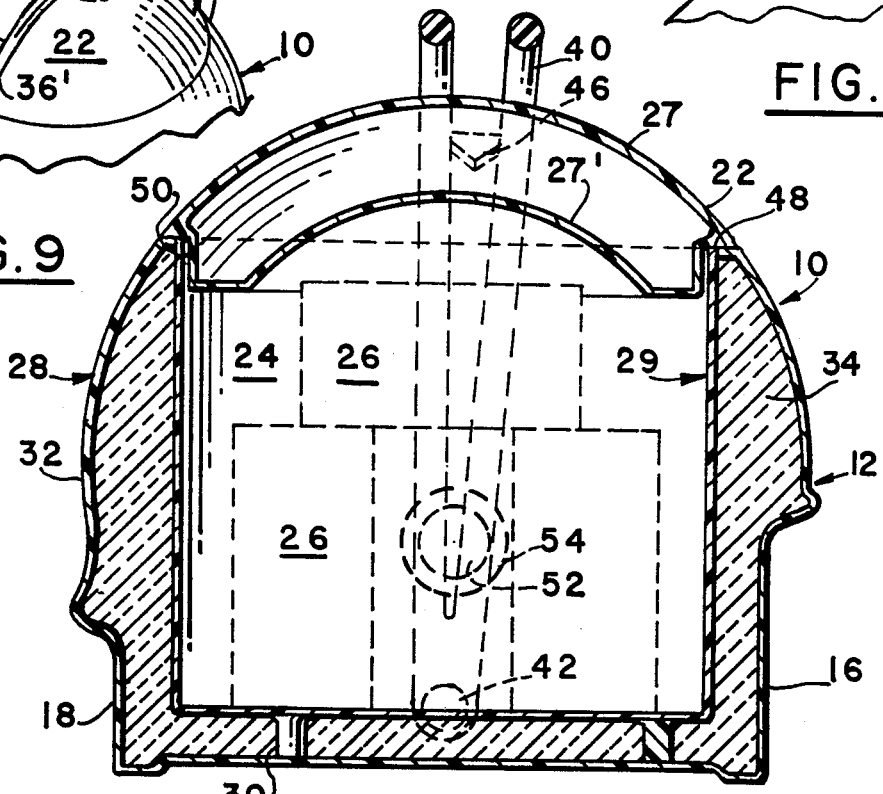
FIG. 8 is a substantially vertical, medial cross-sectional view taken substantially along lines 8—8 in FIG. 7 with the soft drink cans shown in dotted lines illustrating how cans are stacked on top of the bottom cans.

The container housing 28 is molded and comprises an inner container 29 on legs 30 and an outer wall or shell 32 which are spaced apart as shown in FIG. 8 and the space is filled with a plastic foam core insulation 34 which is common in portable coolers. The closure 22 also includes a pair of spaced projections 36, 36' each having a tapered notch or cavity 38 which are part of the latching and retaining means.

Figure 1:
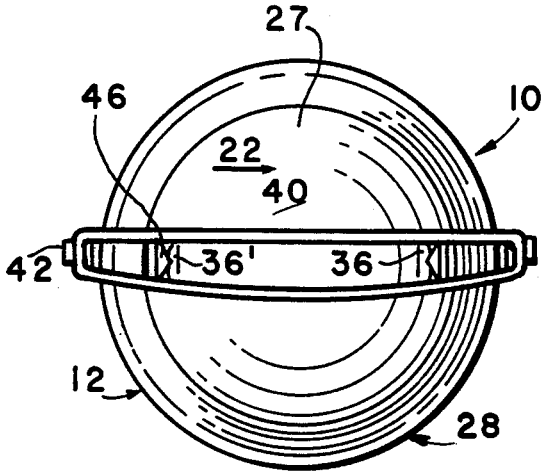
FIG. 1 is a top plan view of the cooler with the handle in latched, carrying position.
Figure 2:
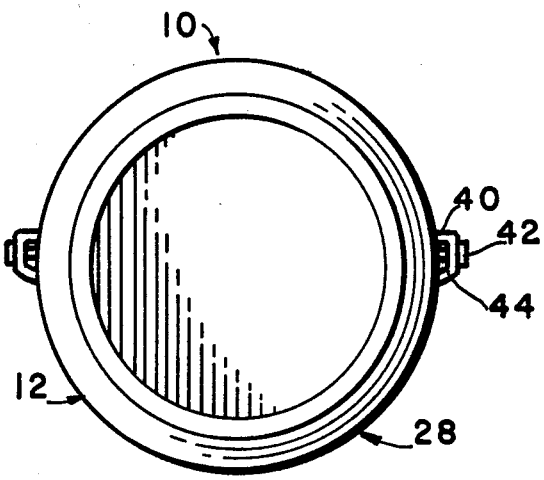
FIG. 2 is a bottom plan view of the cooler.
Figure 3:
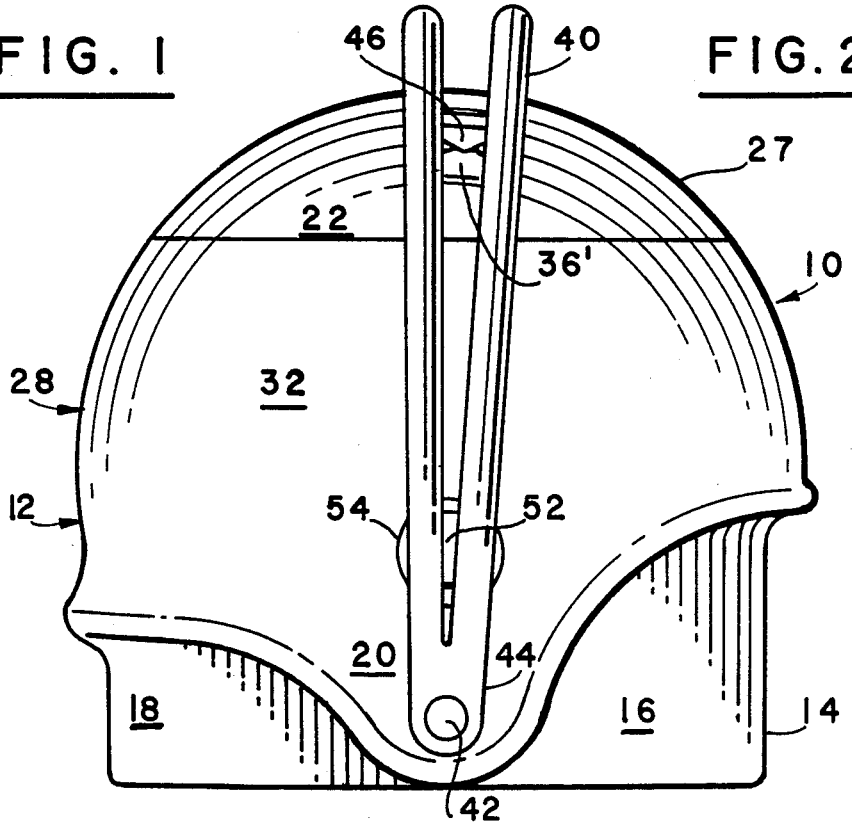
FIG. 3 is a side elevation view of the cooler in FIG. 1.
Figure 4:
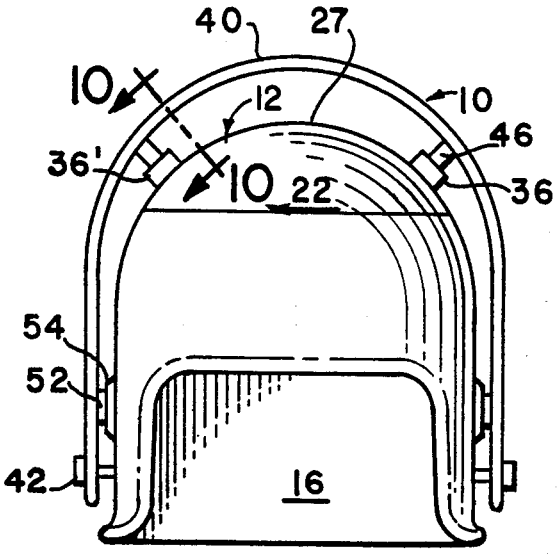
FIG. 4 is a front elevation view of the cooler shown in FIGS. 1-3.
Figure 5:
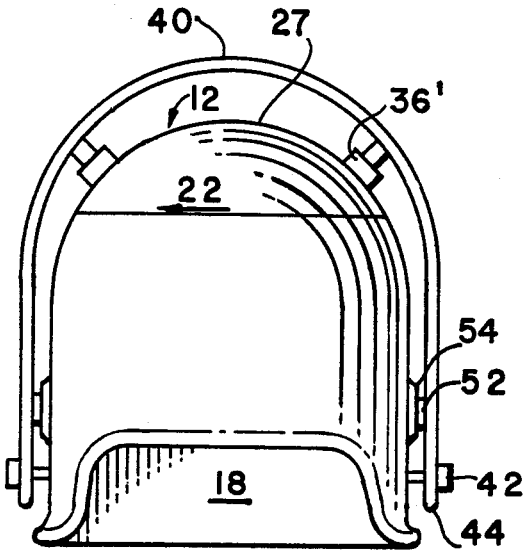
FIG. 5 is a rear elevation view of the cooler shown in FIGS. 1-4.
Figure 6:
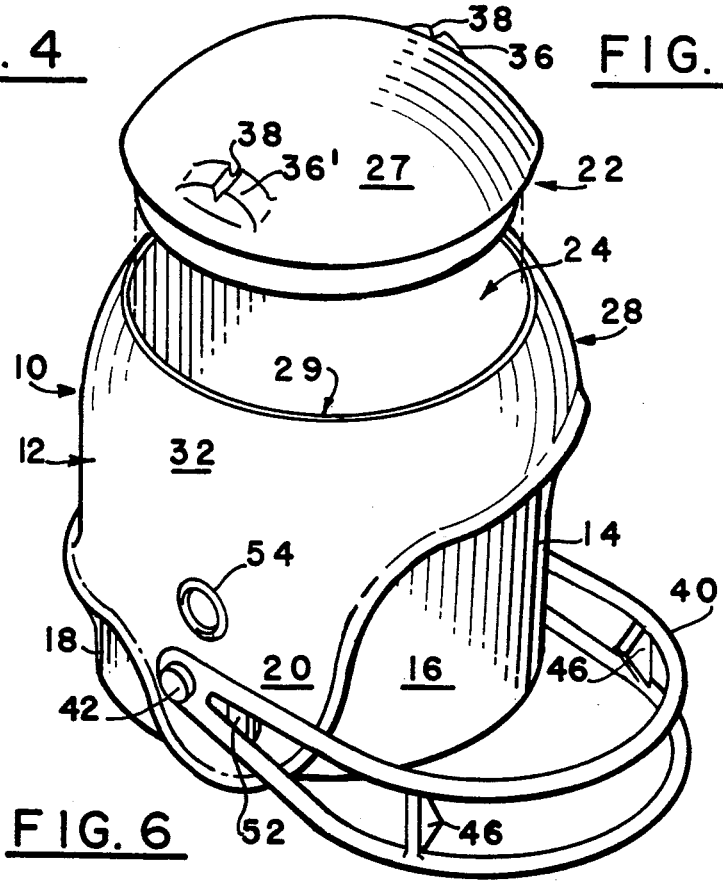
FIG. 6 is a perspective view of the cooler with the handle moved to forward, non-carrying position with the top open and detached.

A handle 40 corresponds to the helmet face mask and is pivotally attached by pivot pins 42 glued into the opposite sides of the ear flaps 20 and having a respective end 44 of handle 40 confined thereon for pivoting from a position extending in front of the face portion 16 (e.g. FIG. 6) which is the normal position of a face mask on a helmet to the position shown in FIG. 3 wherein the handle is upright and over the top of the closure 22. Projecting members 46 are located at opposite positions inside the top of the handle 40 to engage the notches or cavities 38 for the purpose of holding the closure 22 firmly in place. Each projection 46 slides or rides up over the spaced projections 36 and 36' forcing the closure 22 firmly in place around the periphery and ultimately dropping into the notch or cavity 38 so that the handle is firmly in place and has a space above the top of the closure 22 in which a hand may be placed to carry the cooler 10.

The inner container 29 is cylindrical and has the upper peripheral edge 48 thereof even with the upper edge of the outer shell 32 and sealed tightly therewith except for a pressure relief hole 50 running along one edge of the closure 22 as shown in FIG. 8.

Handle 30 also has a pair of small resilient pads 52 located near each end close to the pivot pins 42 for the purpose of engaging a circular indentation or cavity 54 formed in each of the ear flaps 20 to provide additional pressure engagement between the handle 40 and the housing 28 so as to firmly hold handle 40 in place in the upright carrying, closure position shown in FIG. 3 whereby it is less likely that the handle will disengage accidentally from its closure position during the carrying or transit of the cooler 10.

While I have shown and described a particular embodiment of this invention together with a suggested mode of operation thereof this is by way of illustration only as there are various alterations, changes, deviations, eliminations, and substitutions which may be made in the preferred embodiment without departing from the scope of this invention as defined only by a proper interpretation of the appended claims.

What is claimed:

1. In a helmet cooler which looks like a football or other helmet:

a helmet cooler housing, a movable helmet top closure member on said housing, a container space inside said cooler wherein a plurality of soft drink cans may be placed together with crushed ice, a face mask pivotally mounted on pivots on opposite sides of said housing and being movable from a position extending in front of said housing corresponding to where the face would be in a football helmet to a position extending upwardly over said closure on said housing, to provide a handle, and latch means between said face mask in handle position and said closure member.

2. The cooler in claim 1, said latch means comprising:

projecting members on opposite sides of said closure, projecting members on opposite sides of the inside of said handle engageable with said projecting members on said closure for holding said closure in place.

3. The cooler in claim 1, said latch means comprising:

a respective pad located near each respective end of said handle for positioning adjacent each side of said cooler, and a respective cavity formed in said housing to receive each respective pad therein whereby said respective pad is forced into a respective cavity to assist in retaining said handle in upright position.

4. The cooler in claim 1 wherein said container space is defined by a cylindrical container inside said housing.

5. The cooler claimed in claim 1 wherein there is an air hole between said container space and said closure member.

6. In a helmet cooler which looks like a football or other helmet:

a helmet cooler housing comprising an inner shell and an outer shell and there being plastic foam insulation between said inner and outer shell, a removable helmet top closure having an inner wall and an outer wall with an air space therebetween, said closure being the entire top portion of the helmet, a container space inside said cooler wherein a plurality of soft drink cans may be placed upright together with crushed ice, said housing having helmet ear flaps indicated on opposite sides thereof corresponding to the ear flaps on a helmet, a face mask pivotally mounted on pivots on opposite sides of said housing from a position extending in front of said housing corresponding to where the face would be in a football helmet to a position extending upwardly on said housing to provide a handle above the closure, projecting members on opposite sides of said closure, and projecting members on opposite sides of the inside of said handle engageable with said projecting members on said closure for holding said closure in place.

7. The cooler in claim 5, including:

a respective pad located near each respective end of said handle for positioning adjacent said ear flap on each side of said cooler, and a cavity formed in said ear flaps to receive said pad therein whereby said pad is forced into said cavity to assist in retaining said handle in upright position.

8. In a helmet cooler which looks like a football or other helmet:

a helmet cooler housing comprising an inner shell and an outer shell and there being plastic foam insulation between said inner and outer shell, a removable helmet top closure member having an inner wall and an outer wall with an air space therebetween, a cylindrical container inside said cooler defining a space wherein a plurality of soft drink cans may be placed together with crushed ice, a face mask pivotally mounted on pivots on opposite sides of said housing from a position extending in front of said housing corresponding to where the face would be in a football helmet to a position extending upwardly on said housing to provide a handle, and latch means for latching said closure by said face mask handle.

9. The cooler in claim 8 wherein said latch means comprises projecting members on opposite sides of the inside of said handle engageable with said projecting members on said closure for holding said closure in place.

10. The cooler in claim 9, said latch means further comprising:

handle for positioning adjacent said ear flap on each side of said cooler, and a cavity formed in said ear flaps to receive said pad therein whereby said pad is forced into said cavity to assist in retaining said handle in upright position.

* * * * *